United States Patent [19]

Bain, Jr. et al.

[11] Patent Number: 4,748,755

[45] Date of Patent: Jun. 7, 1988

[54] HOUSING ASSEMBLY FOR ELECTRIC STEAMING AND PRESSING IRON

[75] Inventors: Benjamin H. Bain, Jr., Naperville; Henry Prost, Glendale Heights, both of Ill.

[73] Assignee: Sunbeam Corporation, Downers Grove, Ill.

[21] Appl. No.: 947,019

[22] Filed: Dec. 29, 1986

[51] Int. Cl.[4] ..... D06F 75/18; D06F 75/28; D06F 75/30

[52] U.S. Cl. ..... 38/88; 38/77.8; 38/77.81; 38/82; 38/90; 38/93; 219/245

[58] Field of Search ..... 38/88, 90, 93, 77.81, 38/77.8, 77.9, 89, 82; 219/245, 250, 252, 254

[56] References Cited

U.S. PATENT DOCUMENTS

| | | | |
|---|---|---|---|
| 2,427,521 | 9/1947 | Butman | 38/77.81 |
| 3,333,955 | 8/1967 | Walker et al. | 38/93 X |
| 3,718,997 | 3/1973 | Murphy | 38/90 |
| 3,811,208 | 5/1974 | Vieceli et al. | 38/77.8 |
| 4,115,935 | 9/1978 | Toft | 38/88 |
| 4,117,612 | 10/1978 | Baumgartner et al. | 38/91 |
| 4,277,900 | 7/1981 | Gowdy | 38/77.83 |
| 4,357,519 | 11/1982 | Bain, Jr. | 219/256 |
| 4,471,541 | 9/1984 | Schwob | 38/77.8 |
| 4,594,801 | 6/1986 | Gronwick et al. | 38/90 |
| 4,686,352 | 8/1987 | Nawnof et al. | 38/90 X |
| 4,688,340 | 8/1987 | Ostnelich | 38/90 |

FOREIGN PATENT DOCUMENTS

| | | | |
|---|---|---|---|
| 2907619 | 9/1979 | Fed. Rep. of Germany . | |
| 476287 | 12/1937 | United Kingdom | 38/77.81 |

*Primary Examiner*—Andrew M. Falik
*Attorney, Agent, or Firm*—Neil M. Rose

[57] ABSTRACT

A light-weight, primarily plastic, steam pressing iron, which may be assembled without the use of tools and a multiplicity of fasteners, includes a ported aluminum soleplate having a steam generating area and a thermostat, with a rotatable control, a plastic skirt which is snap-fitted onto the soleplate, a plastic housing/handle having a dove-tail connection to the skirt and including a snap-assembled saddle assembly, and a pivotable cord boot retained on the housing/handle by an end cap which is secured thereto by a single threaded fastener. A steam control is operated by a rocker mechanism on the saddle assembly and the rotatable thermostat control is operated by a heat control button which is linearly movable on the saddle assembly. A reservoir in the housing/handle may be provided with either a spray or a non-spray vent cap.

30 Claims, 7 Drawing Sheets

HOUSING ASSEMBLY FOR ELECTRIC STEAMING AND PRESSING IRON

BACKGROUND OF THE INVENTION

Pressing irons are well known in the art. However, most of said known pressing irons are relatively expensive to manufacture due both to costly materials and complex and time-consuming assembly operations. Such pressing irons require a multitude of different fasteners to complete the assembly operation thereof with the cost of assembly labor constituting a substantial portion of the cost of manufacture.

SUMMARY OF THE INVENTION

A combination stream and dry pressing iron is disclosed herein which, with the exception of the soleplate, the thermostat assembly, the electrical wiring and a few minor metallic parts, is fabricated from low-cost plastic parts which may be interfitted together simply and quickly using a single standard-type fastener to form a complete lightweight economical iron with or without a forward spray feature.

The term "steam/dry" is commonly used to describe a pressing iron which may be operated selectively as either a dry iron or a steam iron and this term will be used hereinafter in the specification and the claims appended hereto.

A principal object of the present invention is to provide a new and economical steam/dry iron which is fabricated primarily of plastic parts which are interfitted together in a new and novel mannner utilizing a single standard-type fastener.

Another object of the present invention is to provide such a steam/dry iron having a linearly movable slide control on the saddle portion thereof for adjusting the heat control thermostat.

Still another object of the present invention is to provide such a steam/dry iron wherein the steam/dry control utilizes a rocker arm also mounted on the saddle portion of the iron.

Another object of the present invention is to provide a combined housing and handle subassembly for such a steam/dry iron which is defined by a pair of clam-shell plastic portions which are heat-sealed together to define a reservoir.

Still another object of the present invention is to provide such a steam/dry iron having a new and improved power cord boot which is pivotable through an angle of approximately sixty degrees between an out-of-the-way ironing position and a position in which it aids in supporting the iron in an upright rest position.

Yet another object of the present invention is to provide a steam/dry iron fabricated of plastic parts which are uniquely designed to be interfitted together to form a rigid and sturdy iron without the use of the usual relatively large number of fasteners of various types.

A still further object of the present invention is to provide a steam/dry iron having an improved steam control valve and an enlarged capacity soleplate which substantially improves the steaming capabilities of the iron.

Other objects of the present invention will become obvious to one skilled in the art upon a perusal of the specification and claims in light of the accompanying drawings.

BRIEF DESCRIPTION OF THE DRAWINGS

FIG. 28 is an exploded side elevational view showing the main elements of the iron prior to assembly thereof.

DESCRIPTION OF THE PREFERRED EMBODIMENT

Figure 1:
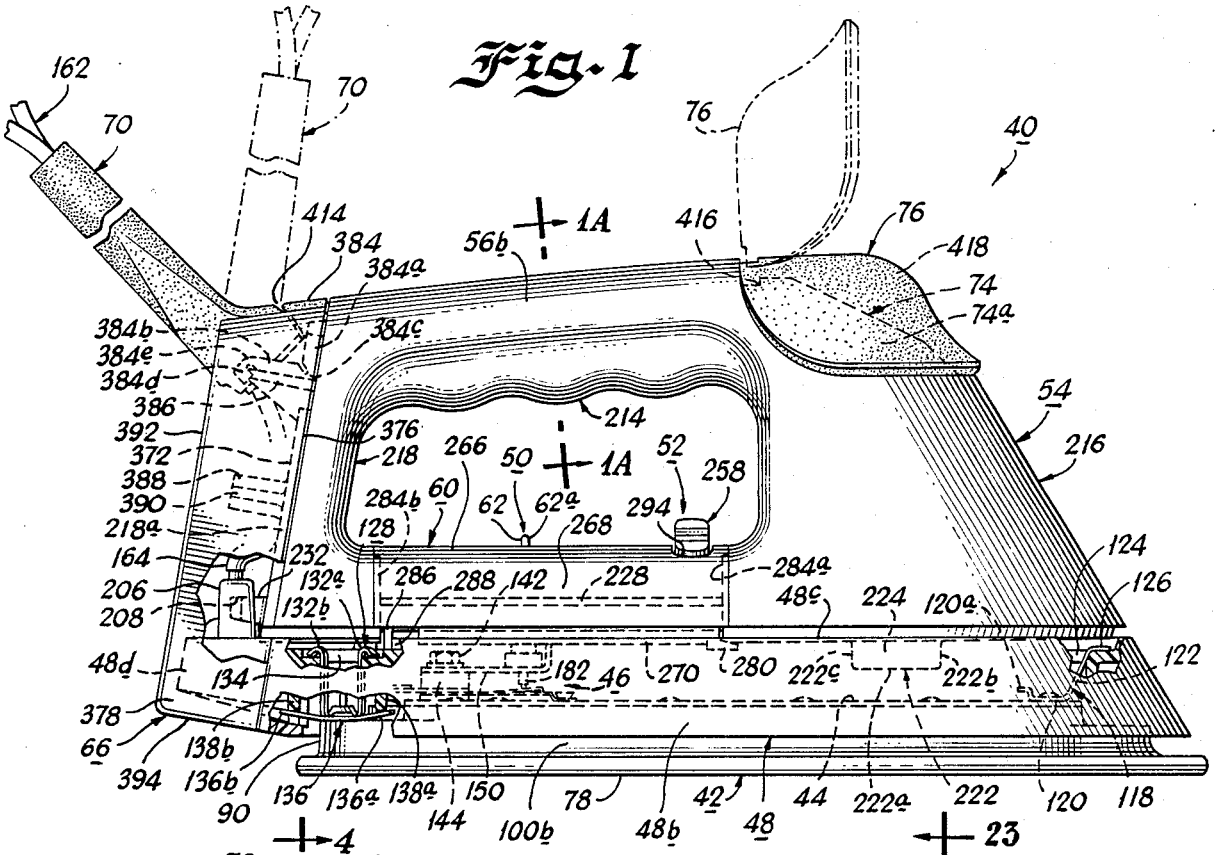
FIG. 1 is a side elevational view of a steam/dry iron embodying the invention partially broken away to better show connection of the skirt to the soleplate and with alternative positions of the cord boot and the vent cap being shown in broken lines.
Figure 2:
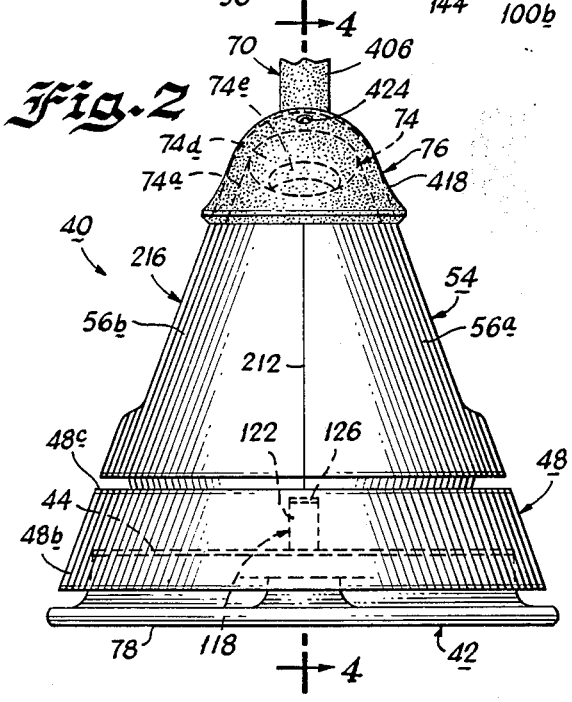
FIG. 2 is a front end elevational view of the iron as shown in FIG. 1.
Figure 1A:
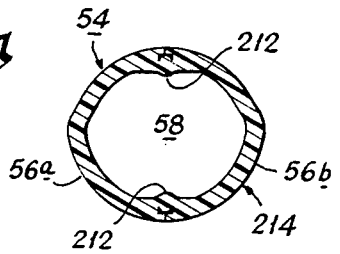
FIGS. 1A and 1B are vertical sectional views taken through the handle of the iron generally on line 1A—1A of FIG. 1 showing the two clam-shell handle/-housing portions which form the combined housing and handle after and before, respectively, heat sealing thereof together.
Figure 1B:
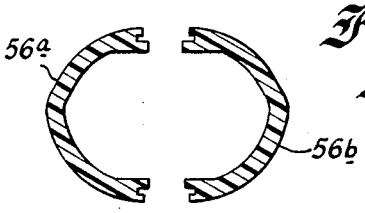
Figures 4, 5, 6, 7, 8:
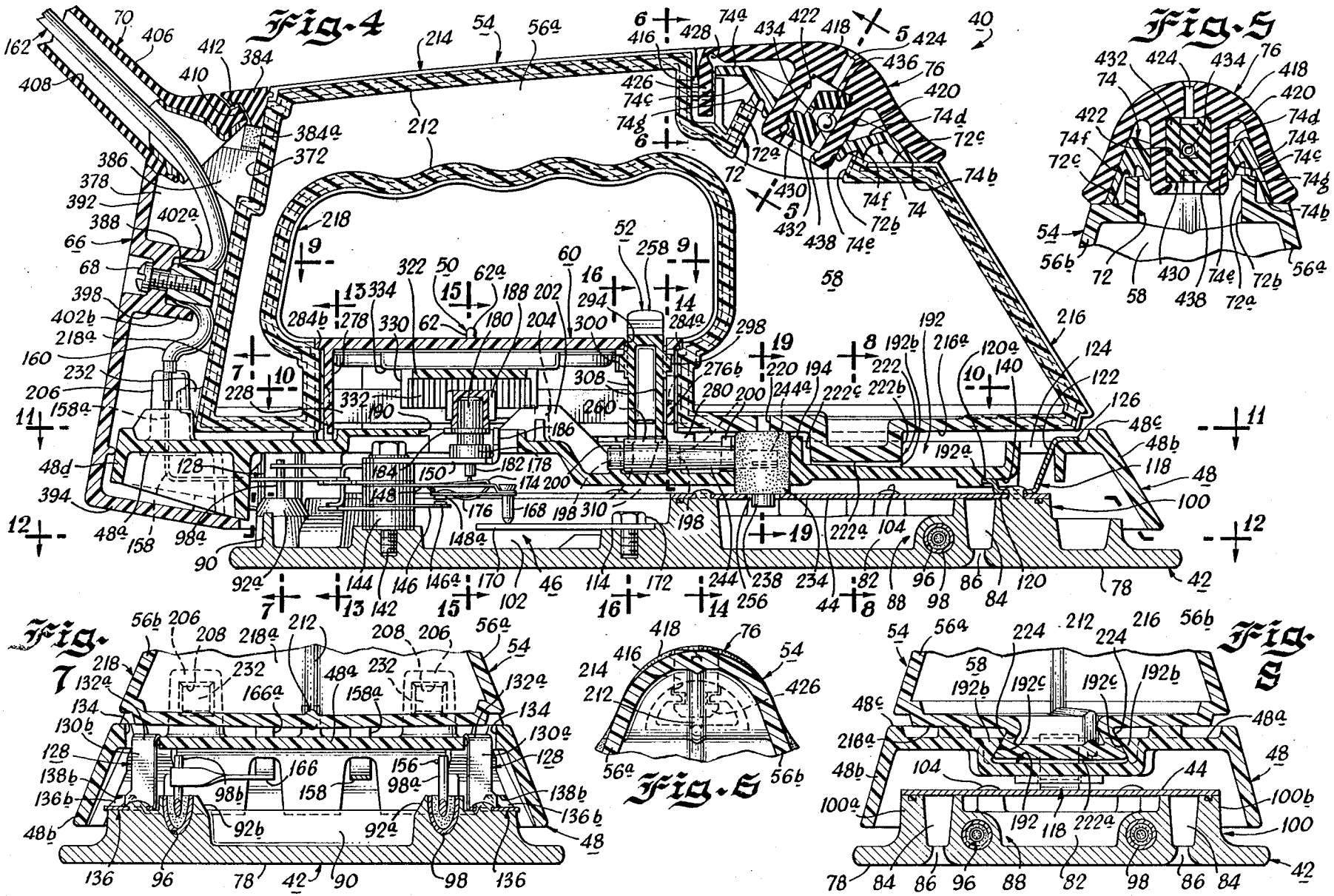
FIG. 4 is a vertical sectional view taken generally on line 4—4 of FIG. 2.
FIG. 5 is a sectional view through the vent-cap taken generally on line 5—5 of FIG. 4.
FIG. 6 is a partial vertical sectional view taken generally on line 6—6 of FIG. 4.
FIG. 7 is a partial vertical sectional view taken generally on line 7—7 of FIG. 4.
FIG. 8 is a partial vertical sectional view taken generally on line 8—8 of FIG. 4.

Referring now to the drawings, and especially FIGS. 1, 4 and 28, a steam/dry pressing iron embodying the invention is generally identified by reference numeral 40. As best illustrated in the exploded view of FIG. 28, the primary elements of the iron 40 are an aluminum soleplate 42 having a cover 44 and a heat control in the form of a thermostat 46 provided thereon, a plastic skirt member 48 which is mounted on the soleplate 42 in a manner to be described, an actuator button 62 of a heat control assembly 50 for the thermostat 46 and a steam control assembly 52 both of which are carried by the saddle member 60, a plastic combined housing and handle 54 which, as best shown in FIGS. 1A, 1B, and 2, is formed by two complementary clam-shell portions 56*a* and 56*b* which are heat-sealed together to define an inverted U-shape reservoir 58 (FIG. 4), which combined housing and handle 54 is easily assembled to the skirt member 48 in a new and novel manner to be described herein, a plastic saddle assembly 60 which is adapted to be snap-fitted onto the combined housing and handle 54 and which carries both the linearly movable heat control or actuator button 62 and the rockable steam control assembly 52, a plastic end cap 66 which is secured to the rear of the combined housing and handle 54 by a single screw-type fastener 68, the only screw-type fastener used in the assembly of the iron 40, and a one-piece rubber-like cord boot 70 which is mounted on the rear of the combined housing and handle 54 and retained thereon by the end cap 66 and which is pivotable between an out-of-the-way use position shown in full line in FIGS. 1 and 23 and a second position shown in FIG. 24 and in broken line in FIG. 1 in which it aids in supporting the iron 40 in an upright rest position. For convenience, the combined housing and handle 54 will hereinafter be referred to in the specification and the appended claims as the "housing/handle". When the two clam-shell portions 56*a* and 56*b* are heat-sealed together, a fill opening 72 is formed in the upper forward corner thereof, which fill opening 72 has a plastic fill-funnel formation 74 heat-sealed therein. A rubber-like plastic vent cap 76 is mounted on the housing/handle 54 adjacent the fill-funnel formation 74 for movement between a first closed position as shown in full line in FIG. 1 and a second open or "fill" position as shown in broken line in FIG. 1.

Figure 21:
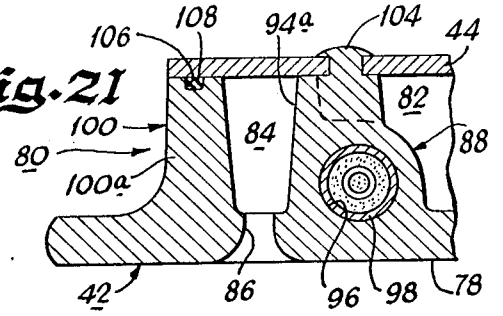
FIG. 21 is an enlarged fragmentary vertical sectional detail view taken generally on line 21—21 of FIG. 12.
Figure 12:
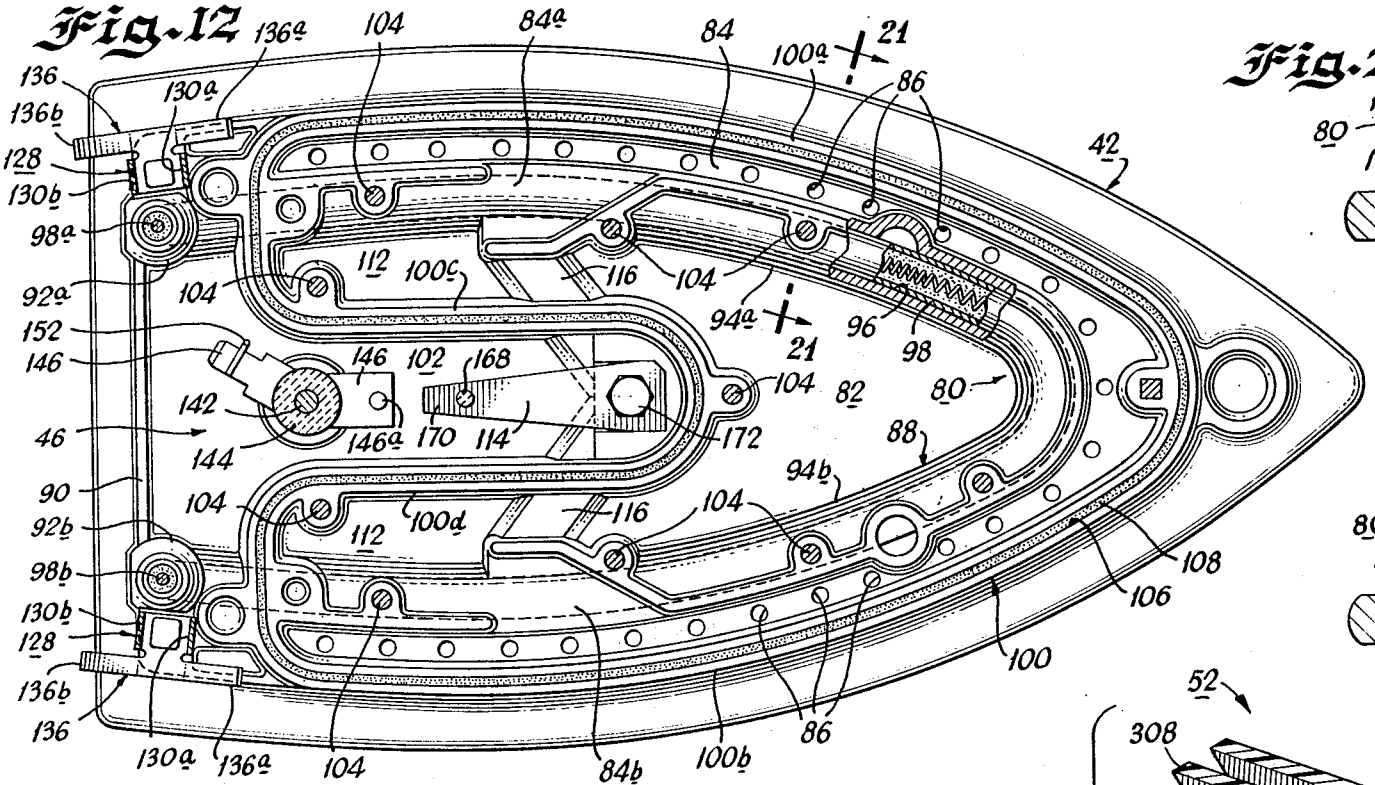
FIG. 12 is a horizontal sectional view taken generally on line 12—12 of FIG. 4.

As best shown in FIG. 21, the soleplate 42 which is preferably diecast of aluminum is provided with a smooth undersurface 78 for ironing contact with the material to be pressed and on its upper surface with a series of upstanding wall formations 80 defining an area 82 for the generation of steam and passage means 84 for the delivery of said steam to a series of steam ports 86 which extend through the soleplate 42 to the undersurface 78 thereof. With reference also to FIG. 12, a first wall formation 88 has a first rear portion 90 extending across the rear of the soleplate 42, spaced slightly forwardly of the rear edge thereof, between a pair of upright post formations 92*a* and 92*b* and two side portions 94*a* and 94*b* which extend forwardly from said post formations 92*a* and 92*b* and which curve inwardly whereby they meet and are integrally joined near the nose of the soleplate 42 (FIG. 12). The two post formations 92*a* and 92*b* have defined therein vertically disposed bores which intersect with a horizontally disposed continuous bore 96 defined in the wall formation 88 in which a known-type heating element 98 is diecast, the structure of the heating element 98 being best illustrated in the broken away portion of FIG. 12, with the two terminal ends 98*a* and 98*b* thereof projecting upward from said upstanding post formations 92*a* and 92*b*. Diecasting the heating element 98 in the first wall formation 88 defines the continuous bore 96 and the bores in the post formations 92*a* and 92*b*. With the specific heating element 98 shown in the broken away portion of FIG. 12 wherein certain coils are more tightly spaced than others, a differential wattage distribution is provided with less wattage and lower heating in the nose curve portion of the heating element 98 and greater wattage and higher heating in the rearward side portions thereof, for reasons to be further discussed hereinafter.

A second continuous upstanding wall formation 100 (FIG. 12) has two side portions 100*a* and 100*b* which extend rearwardly from the nose portion of the soleplate 42 outwardly of said first wall formation 88 and, at points forwardly of said upstanding posts 92*a* and 92*b*, turn inwardly and across said side wall portions 94*a* and 94*b* and then turn forwardly, as at 100*c* and 100*d*, toward approximately the longitudinal center of said soleplate 42 where they curve inwardly and meet whereby to define both the large boiler or steam generation area 82 with said first wall formation 88 and an elongated space 102 for the heat control thermostat 46 between said second wall portions 100*c* and 100*d* and said rear wall portion 90 of said first wall formation 88. The distribution passage means 84 is defined between said side wall portions 94*a* and 94*b* and said side wall portions 100*a* and 100*b* with a pair of passageways 84*a* and 84*b* being provided between the steam generation area 82 and the distribution passage means 84.

Figure 22:
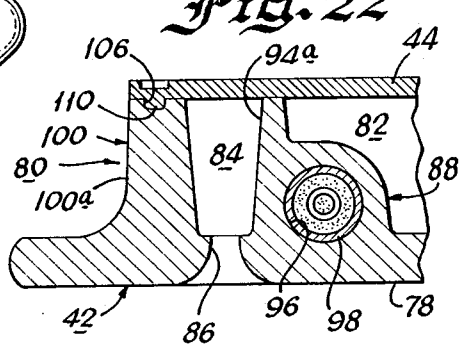
FIG. 22 is an enlarged fragmentary vertical sectional detail view similar to FIG. 21 showing an alternative form of assembly of the soleplate cover to the soleplate.

The soleplate cover 44, which is also preferably formed of aluminum, is mechanically fastened to the soleplate 42 by riveting over cast-in bosses on the first wall formation 88, as at 104 in FIG. 21. A preferred method of sealing the cover 44 to the soleplate 42 is also shown in FIG. 21 wherein a continuous groove 106 is formed in the upper surface of said second wall formation 100 with a suitable known RTV sealant 108 being provided in the groove 106. A second method of sealing the cover 44 to the soleplate 42 is shown in FIG. 22 wherein a suitable tool is used to physically displace the cover material overlying the groove 106 into the groove 106, as as 110 in FIG. 22, to provide a suitable sealing relationship between the soleplate 42 and the cover 44. This latter method may be referred to as a staking operation.

The average hard water steam life of the soleplate design of this disclosure is extended and improved over known prior art designs of non-selfcleaning soleplates due to the construction of the steam generation area 82 and the distribution passage means 84. The present design does not eliminate deposits created by hard water evaporation but rather deals with the deposits as a stored by-product of steam generation and allows for larger quantities of these deposits to be created and stored before choking off the steam performance of the soleplate 42. Known non-self cleaning soleplate designs of the prior art collect the deposits created by hard water evaporation but, in view of their narrow passages and smaller steam generation areas, choke off the steam performance after substantially less use than the present design permits. Again with reference to FIG. 12, as water is metered into the steam generation area 82 it is allowed to spread out in this relatively large area due to a specially formulated painted-on material, which, when dry, has a surface which breaks the surface tension of the metered water drops. Such materials are well known in the steam iron art. The spreading out or wicking of the metered amounts of water in the steam generation area 82 permits a highly efficient heat transfer for vaporization between the water and the aluminum material of the soleplate 42 which is heated by the heating element 98. The larger than normal steam generating area 82 can accumulate significantly more attached hard water deposits than smaller steam generation areas of prior art soleplates, thus allowing the present steam generating design to steam through more hard water and last longer as a performing product. Many of the deposits which form from hard water evaporation do not attach to the surface of the steam generating area 82 but rather become loose chalky flakes. These loose flakes are provided for in the present design by providing large storage areas 112 at the heel or rear of the steam generating area 82. The storage areas 112, on both sides of the soleplate 42 at the rear portion of the soleplate 42, collect large amounts of loose deposit flakes without clogging the steam output ports 86 which are disposed forwardly of the rear storage areas 112.

The upper surface of the first wall formation 88 which defines the outer periphery of the steam generating area 82 is in contact with the underside of the soleplate cover 44 whereby it prevents water drops from getting into the steam delivery passage means 84 before evaporation or the formation of steam.

The balanced temperature distribution of the present design is accomplished by means of balancing the following three design elements: (1) the differential wattage distribution in the heating element 98 which provides less wattage or lower heating in the nose portion of the heating element 98 and greater wattage or higher heating in the rearward legs of the heating element 98, (2) a sensor 114 for the thermostat 46 being attached to the diecast soleplate 42 at a position (FIG. 4) which is centrally located near the steam generating area 82 and adjacent to the higher wattage portions of the heating element 98, and (3) thicker diecast soleplate sections 116 which are provided to improve the sensitivity of the thermostat sensor 114 to the higher wattage areas of the heating element 98. These three design elements provide improved soleplate temperature distribution in both dry and steaming modes. The thicker sections or thermal shunts 116 function as higher heat flow channels for energy to move to lower temperature, water boiling areas of the soleplate 42. By channeling more of the steam generating energy through the temperature sensor 114, a more even soleplate temperature distribution is accomplished in the steaming mode. In the dry mode, the temperature sensor 114 is more sensitive to the higher heat areas because the thermal shunts 116 move the energy to the sensor 114 quickly for quicker response and more even soleplate temperature distribution. It is noted that the steam ports 86 are positioned only outwardly of the heating element 98 whereby to allow additional room for the relatively large steam generation area 82 and the relatively large hard water deposit storage areas 112.

The plastic skirt 48, which, as best illustrated in FIGS. 1, 4, 8, 14 and 28, is characterized by a generally flat, horizontally disposed top portion **48*a*, by a depending peripheral skirt portion 48*b*, and by an upstanding peripheral lip 48*c*, is positively connected to the soleplate 42 in a simple manner which requires the use of no tools. This novel method of assembly, which requires a minimum amount of time, is a snap-action type assembly utilizing spring-type latch means provided on the soleplate 42 and recess means provided in the plastic skirt 48**.

As best illustrated in FIGS. 1 and 4, a modified S-shaped latch member 118 is characterized by having a lower leg portion 120 riveted or otherwise secured to the nose portion of the soleplate 42 or soleplate cover 44, by an upwardly and forwardly inclined portion 122 adapted to extend upwardly through an opening 124 formed in the top portion **48*a* of the nose of the skirt 48 and centered on the longitudinal axis of the skirt 48, and by a gripping portion 126 which extends forwardly from the upper end of the inclined portion 122 and is adapted for gripping engagement with the top portion 48*a* of the skirt 48 forwardly of the opening 124. The leading edge of the opening 124 may be beveled or curved, as is best illustrated in FIG. 4, to facilitate hooking engaging of the latch member 118 in the opening 124**.

Figures 11, 15, 16, 17, 18:
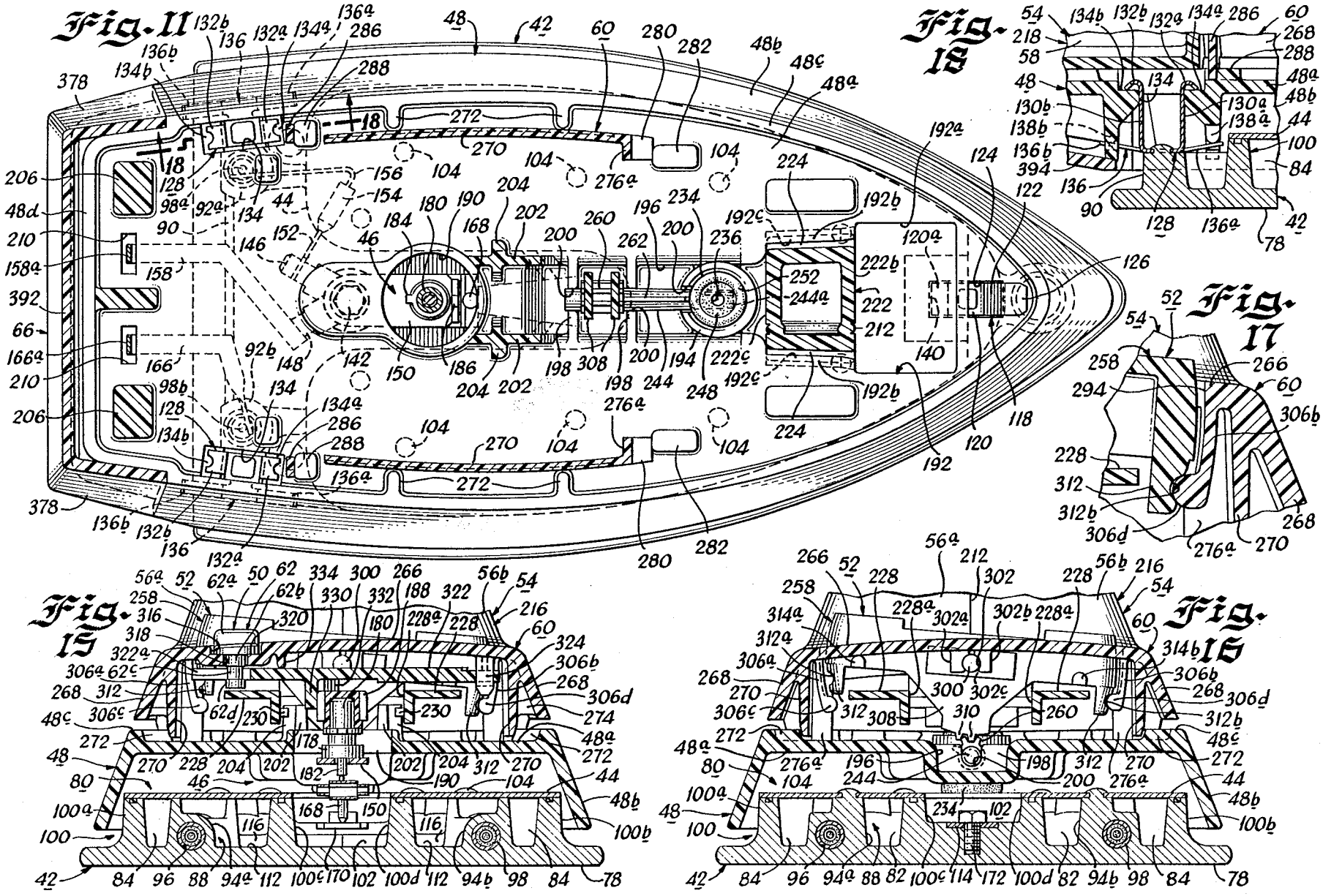
FIG. 11 is a horizontal sectional view taken generally on line 11—11 of FIG. 4.
FIG. 15 is a partial vertical sectional view taken generally on line 15—15 of FIG. 4.
FIG. 16 is a partial vertical sectional view taken generally on line 16—16 of FIG. 4.
FIG. 17 is an enlarged fragmentary sectional detail view taken generally on line 17—17 of FIG. 10.
FIG. 18 is an enlarged fragmentary vertical sectional detail view taken generally on line 18—18 of FIG. 11.

The rear portion of the skirt 48 is snap-fastened to the soleplate 42 by a pair of U-shaped spring clips 128 which are riveted or otherwise secured to the soleplate 42 outwardly of the two post formations **92*a* and 92*b*, as best illustrated in FIGS. 7, 11, 12, 18, and 28, with vertical arms 130*a* and 130*b* thereof being spaced forwardly and rearwardly of the soleplate 42 and having forwardly and rearwardly bent upper ends 132*a* and 132*b* which are grippingly engageable over forward and rear edges 134*a* and 134*b*, respectively, of aligned openings 134 provided in the top portion 48*a* of the skirt 48 adjacent the opposite rear corners thereof. Prior to assembly of the skirt 48 to the soleplate 42, the arms 130*a* and 13*b* of the spring clips 128 are biased away from one another a distance larger than the distance between the front and rear edges 134*a* and 134*b* of the openings 134 with the arms 130*a* and 130*b* being forced toward one another during assembly of the rear portion of the skirt 48 to the soleplate 42 to permit relative movement of the spring clips 128 through the openings 134 whereupon the arms 130*a* and 130*b* are permitted to spring apart into latching engagement over the forward and rear edges 134*a* and 134*b* of the openings 134, as is best illustrated in FIG. 18. Also, as best illustrated in FIG. 18, the forward and rear edges 134*a* and 134*b* are defined by depressions provided in the top portion 48*a* of the skirt 48**.

As most clearly illustrated in FIGS. 12, 18 and 28, each spring clip 128 is further characterized by an integral outrigger-positioned, upwardly biased leaf spring formation having forwardly and rearwardly extending portions **136*a* and 136*b* adapted to be forced downwardly by rib formations 138*a* and 138*b* depending from the underside of the portion 48*a* of the skirt 48 as an aid in stabilizing the mounting of the skirt 48 on the soleplate 42. The subassembly including the skirt 48** and the soleplate 42 will be referred to in this specification and the attached claims as the "soleplate/plastic skirt subassembly" or simply the "soleplate/skirt subassembly".

Extending rearwardly from the opening 124 for the latch 118 along the longitudinal axis of the skirt 48, the material of the top portion 48*a* of the skirt 48 is offset downwardly to define a series of recesses to be described more fully hereinafter. The top portion 48*a* of the skirt 48 is further characterized by additional openings and raised portions also to be described more fully hereinafter.

To further stabilize the skirt 48 against undesirable forward movement thereof relative to the soleplate 42 after the two have been assembled together, the riveted rear leg 120 of the front latch 118 is provided with an upwardly and rearwardly offset portion 120*a* which, as best shown in FIG. 4, abutts against the rear edge of a downwardly opening recess 140 formed in the front portion of the previously mentioned downwardly offset portion of the top portion 48*a* of the skirt 48.

The thermostat 46 mounted on the soleplate 42 in the space 102 provided therefor is characterized, as best shown in FIG. 4, by a post 142 threadedly secured in the soleplate 42 upon which an alternating series of insulators 144 and lower and upper contact leaves 146 and 148 are supported, together with an upper support bracket 150. The lower leaf 146, which has an upwardly facing contact 146*a*, is connected, as best shown in FIG. 11, by a lead 152 to a fuse 154 which, in turn, is connected by a lead 156 to terminal 98*a* of the heating element 98. The upper leaf 148 is connected by an anglar connector 158 having an upwardly directed terminal end portion 158*a* to one lead 160 (FIG. 3) of a power cord 162. A second lead 164 of the power cord 162 is connected through a similar angular connector 166, having an upwardly connected end portion 166*a*, to the other terminal 98*b* of the heating element 98.

The upper leaf 148 is a compound leaf having an insulated finger 168 at its outer end which extends downwardly and is engageable by a free end 170 of the thermostat sensor 114 which is secured to the soleplate 42 by a bolt 172. The compound upper leaf 148 is also characterized by an upwardly offset portion 174 and by a downwardly offset portion 176. The thermostat support bracket 150 has an opening formed therein with an internally threaded annular member 178 secured coaxially thereon in vertical alignment with the upwardly offset portion 174 of the upper leaf 148. An externally threaded member 180 is rotatable in threaded engagement with the annular member 178 with a depending coaxial insulated member 182 engaging the upwardly offset portion 174 of the leaf 148 and being movable vertically in response to rotation of the externally threaded member 180. The member 180 may be provided with a radially projecting abutment 184 which is engageable with a stop member 186 provided on the support bracket 150 to limit rotation of the member 180 to less than 360°. The downwardly offset portion 176 of the upper leaf 148 carries a downwardly facing contact 148*a* which is vertically aligned with the leaf contact 146*a*. The rotatable member 180, which has a pinion gear 188 secured on its upper end, is part of the heat control assembly 62, the actuating portion of which will be described hereinafter. The heating element 98 is energized when there is engagement of the leaf contact 148*a* with the leaf contact 146*a*. When the desired soleplate temperature is reached, this contact is automatically broken and the heating element is de-energized. It is noted that the rotatable member 180 and the pinion gear 188 secured thereon project upwardly through an opening 190 provided in the top portion 48*a* of the skirt 48.

Referring once again to the plastic skirt 48, the previously mentioned offset recesses and raised portions are provided as means for quickly assembling the housing/handle 54 to the soleplate/plastic skirt subassembly 42/48 without the use of tools or mechanical fasteners. Immediately rearwardly of the opening 124 for the front latch 118 is a generally rectangular recess 192 (FIGS. 4 and 11) with the forward portion defining a receiving area 192*a* and the rear portion having planar side rail configurations 192*b* which converge both rearwardly and upwardly whereby to define a forwardly opening female portion 192*c* of a dove-tail latching arrangement, the purpose for which will be discussed hereinafter.

At the rear of the recess 192 is a vertically disposed sleeve configuration 194 defining an opening through the top portion 48*a* of the skirt 48, the purpose for which will be discussed hereinafter in connection with the steam control 52. Extending rearwardly from the sleeve configuration 194 is a narrower recess 196 having a pair of transverse ribs 198 extending thereacross. The ribs 198 and the sleeve configuration 194 are provided with longitudinally aligned, upwardly opening U-shaped slots 200 which define a cradle configuration which will also be discussed further hereinafter in connection with the steam control assembly 52. The previously identified opening 190 for the rotatable member 180 of the heat control assembly 62 is spaced rearwardly of the cradle formation recess 196.

Between the recess 196 and the opening 190 there is provided on the top part 48*a* of the skirt 48 a pair of longitudinally extending, transversely aligned truncated triangular formations 202 which are disposed parallel to one another and spaced equidistantly from and on opposite sides of the longitudinal axis of the skirt 48. Each triangular formation 202 has a vertically disposed latching rib or projection 204 on its outer surface, the two ribs 204 being transversely aligned with one another. The opposite rear corners of the top portion 48*a* of the skirt 48 are each provided with an upstanding abutment 206 having a forwardly facing recess 208 (FIG. 7) formed therein. The ribbed triangular formations 202 and the recessed abutments 206 cooperate with the previously noted dove-tail latch arrangement in the assembly of the housing/handle 54 to the soleplate/skirt subassembly 42/48 as will be described hereinafter. Two laterally extending slots 210 are formed in the rear of the top portion 48*a* of the skirt 48 between the abutments 206 to accommodate upward passage therethrough of the vertically extending portions of the angular connectors 158 and 166 of the heating element 98 circuit.

Figures 9, 10, 13, 14:
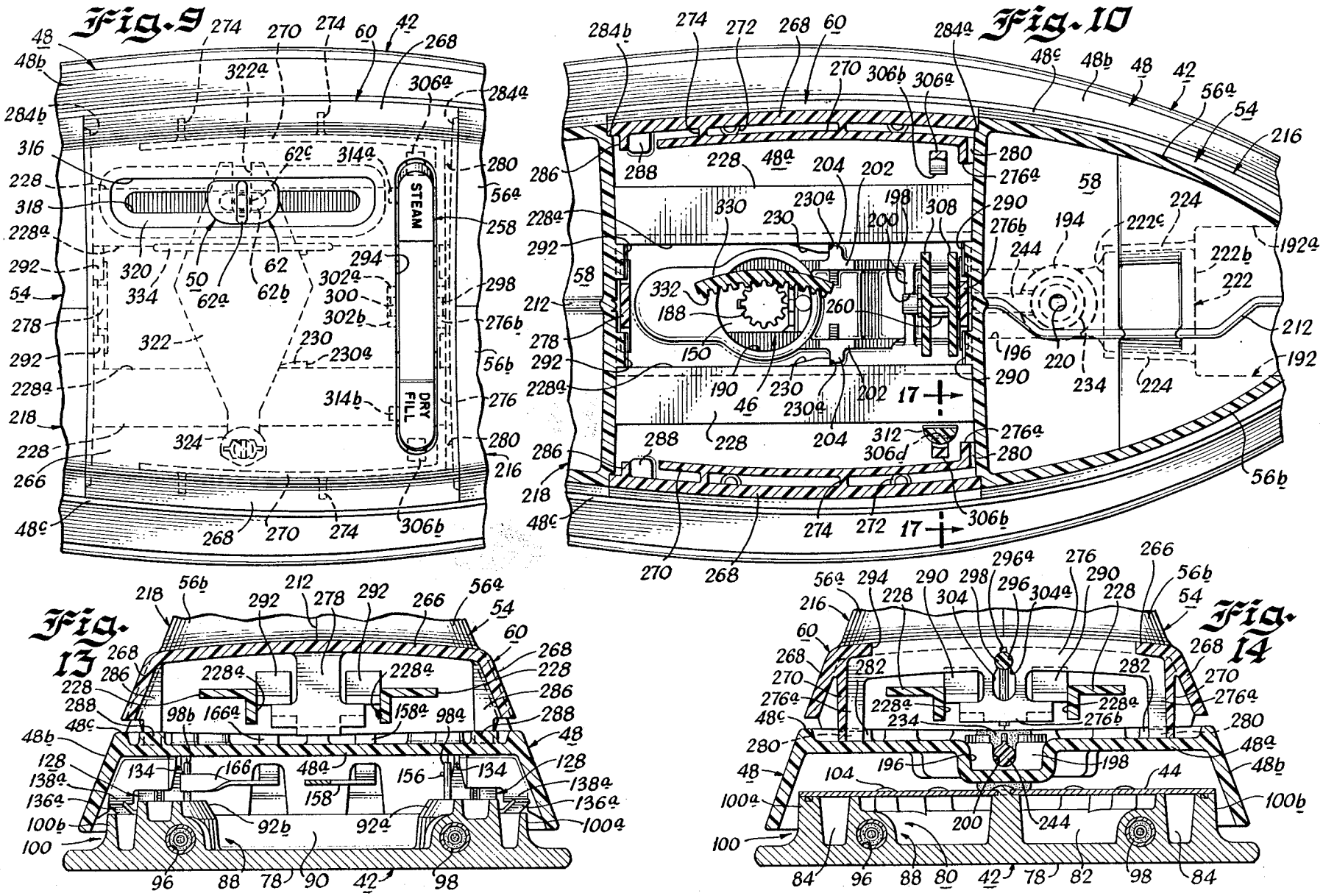
FIG. 9 is a partial top plan view taken generally on line 9—9 of FIG. 4.
FIG. 10 is a partial horizontal sectional view taken generally on line 10—10 of FIG. 4.
FIG. 13 is a partial vertical sectional view taken generally on line 13—13 of FIG. 4.
FIG. 14 is a partial vertical sectional view taken generally on line 14—14 of FIG. 4.
Figure 19:
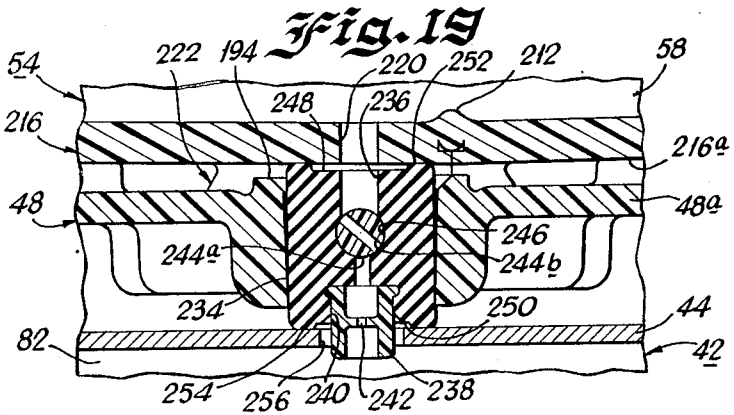
FIG. 19 is an enlarged fragmentary vertical sectional detail view taken generally on line 19—19 of FIG. 4.

As previously described herein, the plastic housing/handle 54 is formed by two complementary clam-shell portions 56*a* and 56*b* which are heat sealed together, the heat seal joint being identified by reference numeral 212. The housing/handle 54 is characterized by an upper handle or hand-grip portion 214, by a front end portion 216 depending from the front end of the handle portion 214, and by a rear end portion 218 depending from the rear end of the handle portion 214. These three areas are hollow and interconnected whereby to define the relatively large water reservoir 58 which is fillable through the fill-funnel formation 74 heat sealed in the fill opening 72. As shown in FIGS. 4, 10 and 19, a small reservoir discharge port 220 is provided in a bottom wall 216*a* of the front end portion 216. As best shown in FIGS. 4 and 8, a portion of the bottom wall 216*a* of the front end portion 216 is downwardly offset to define a complementary male portion 222 of the previously mentioned dove-tail latch arrangement, which male portion 222 is characterized by planar side walls 224 (FIG. 8) which converge both upwardly and rearwardly from a bottom surface 222*a* thereof, transversely disposed front and rear walls 222*b* and 222*c* of male portion 222 being vertically disposed. As noted in FIGS. 8 and 10, the heat seal joint 212 is laterally offset adjacent the discharge port 220 from the reservoir 58 so as not to distort same.

The housing/handle 54 is further characterized by a pair of integral parallel rail members 228 which extend longitudinally between the lower portions of the front and rear end portions 216 and 218, respectively, as best illustrated in FIGS. 10 and 15. Inner facing surfaces 228*a* of the rail members 228 are provided, approximately midway between the opposite ends thereof, with transversely aligned inwardly and forwardly inclined projections 230 having forwardly facing front end surfaces 230*a* (FIG. 10).

A rear wall 218*a* of the rear end portion 218 of the housing/handle 54 is provided adjacent its bottom edge with a pair of rearwardly directed projections 232 which are spaced apart a distance equal to the spacing between the two recessed abutments 206 on the rear portion of the skirt 48, the projections 232 being of a size and shape to be received in the recesses 208 formed in the abutments 206.

To assemble the housing/handle 54 to the soleplate/-skirt subassembly 42/48, the housing/handle 54 is positioned on the subassembly 42/48 with the male portion 222 of the dove-tail latching arrangement disposed in the forward receiving portion 192*a* of the recess 192 in the skirt 48 and the rear projections 232 aligned with the recessed abutments 206 on the skirt 48. The housing/-handle 54 is then moved rearwardly relative to the subassembly 42/48 whereby the dove-tail male portion 222 moves into latching engagement in the female dove-tail recessed portion 192*c* simultaneously as the rear projections 232 move into anchored engagement in the recessed abutments 206 and, simultaneously, as the rail members 228 are flexed outwardly as a result of the engagement of the inclined projections 230 thereon with the ribs 204 on the triangular formations 202 until the inclined projections 230 clear the ribs 204 whereupon the rail members 228 unflex inwardly to engage the front surfaces 230*a* of the inclined projections 230 behind or rearwardly of the ribs 204 and thus effectively lock the housing/handle 54 against any forward movement relative to the soleplate/skirt subassembly 42/48, the dove-tail arrangement 192*c* /222 and the rear projections/recessed abutment arrangement 232/206 effectively preventing either rearward or upward movement of the housing/handle 54 relative to the soleplate/skirt subassembly 42/48. This simple, but effective, novel assembly operation is also accomplished quickly without the use of tools or mechanical fasteners.

Figure 20:
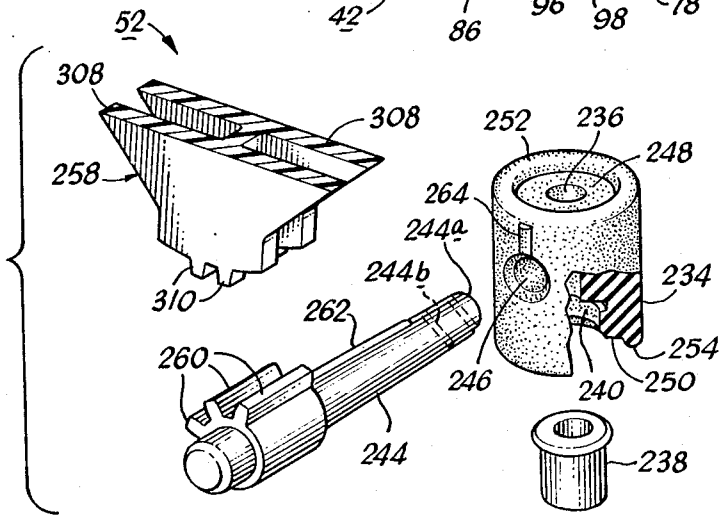
FIG. 20 is an enlarged exploded perspective view of the elements forming the steam control to permit operation of the iron as a steam or as a dry iron.

The steam control assembly 52 includes a three-piece valve assembly (FIGS. 19 and 20) including a rubber-like, plastic sleeve 234 which is received in the sleeve configuration 194 and which has axial passage means 236 extending therethrough, an orifice housing 238 formed of a material having suitable wettability characteristics mounted in a lower portion 240 of the sleeve passage means 236 and having a metering orifice 242 (FIG. 19) formed therein, and an elongated, horizontally disposed valve member 244 rockably supported in the aforesaid cradle configuration defined by the U-shaped slots 200 provided in the sleeve 194 and the transverse ribs 198 and having a forward end 244*a* thereof rotatably received in a radial opening 246 extending through the side wall of the rubber-like sleeve 234 above the orifice housihg 238. The forward end 244*a* of the valve member 244 is provided with a diametrical slot 244*b* which, in either of two 180° apart "open" positions of the valve member 244, provides clear passage means from the upper end of the axial passage 236, through the slot 244*b*, to the orifice 242. In all other rotatable positions of the valve member 244, the axial passage 236 is sealed closed by the unslotted portion of the forward end 244*a* of the valve member 244. As best illustrated in FIGS. 19 and 20, the upper and lower ends of the rubber-like sleeve 234 are characterized by central depressions 248 and 250, respectively, whereby to define annular, peripheral lips 252 and 254, respectively, for sealing opposite ends of the axial passage means 236 when the housing/handle 54, the plastic skirt 48 and the soleplate 42 are assembled together (see FIG. 19). When assembled, the upper end of the axial passage means 236 is vertically aligned with the reservoir discharge port 220 with the upper peripheral lip 252 sealing against the underside or bottom wall 216*a* of the front end 216 of the housing/handle 54 outwardly of the discharge port 220 and the lower end of the orifice housing 238 extends downwardly through an opening 256 provided in the soleplate cover 44 above the steam generator area 82 with the lower peripheral lip 254 sealing against the soleplate cover 44 outwardly of the soleplate cover opening 256. Thus, when the valve member 244 is in its "open" position, water from the reservoir 58 is metered through the orifice 242 into the steam generator area 82 for "steam" ironing. For "dry" ironing, the valve member 244 is rotated into a closed position.

A unique rocker member 258 of the steam control assembly 52 for rotating the valve member 244 between its "open" and "closed" positions is fully described hereinafter. For driving engagement with the rocker member 258, a series of three longitudinally extending cogs or gear teeth 260 (FIGS. 16 and 20) are integrally formed on the periphery of the non-slotted rear end of the valve member 244 approximately 40° apart, the valve member 244 being supported in the cradle assembly 200, 194, 198 with the gear teeth 260 projecting generally upwardly and with a longitudinally extending guide rib 262 positioned circumferentially midway between two of the gear teeth 260 and being alignable, for assembly purposes, with a vertically disposed guide rib 264 integrally formed on the rearmost outer surface of the sleeve 234 in a vertical plane diametrically bisecting the side opening 246 for the valve member 244. This is one of the two limit positions of the valve member 244, in which limit position the axial passage means 236 is closed above the orifice 242, as for "dry" ironing. Clockwise rotation of the valve member 244 (as viewed from the rear) through approximately 40°, into its other limit position, serves to vertically align the slot 244*b* with the axial passage means 236 whereby to open the orifice 242 for "steam" ironing. As best illustrated in FIG. 11, the gear teeth 260, when the valve member 244 is assembled in the cradle assembly 200, 194, 198, are disposed between the two transverse ribs 198.

In proceeding with the assembly of this unique iron 40, either the saddle assembly 60 or the end cap 66 and cord boot 70 may be assembled next. The saddle assembly or member 60, which carries both the mechanisms of the heat or temperature control assembly 50 and the steam control assembly 52, is characterized by a slightly curved top wall 266 and by a downwardly depending double side-wall contruction with an outer wall portion 268 thereof being inclined outwardly and terminating in spaced relationship above the peripheral lip 48*c* of the skirt 48 for ventilation purposes and with an inner wall portion 270 thereof being disposed generally vertically and terminating in spaced relationship above the top portion 48*a* of the skirt 48, also for ventilation purposes, and being engageable against inner ends of locating ribs 272 (FIG. 11) integrally formed on the top portion 48*a* of the skirt 48 and extending inwardly from the lip 48*c*, as best illustrated in FIGS. 11, 15 and 16, whereby to provide lateral stability of the saddle assembly 60. At least two longitudinally spaced, integral, transverse stabilizing ribs 274 (FIG. 10) are provided between each set of walls 268 and 270 of the saddle assembly double-side-wall construction.

Depending from the top wall 266 of the saddle assembly 60, adjacent to but slightly rearwardly of the forward edge thereof, and integrally connected between the front edges of the inner walls portions 270 is a generally M-shaped front wall formation 276 (FIG. 14) having depending outer leg portions 276*a* and a depending inverted T-shaped portion 276*b* disposed midway therebetween which has some forward and rearward flexibility for a reason to be discussed hereinafter. A similar integral, but flexible, inverted T-shaped formation 278 (FIG. 13) depends from the underside of the top wall 266 of the saddle assembly 60 adjacent the rear edge thereof and in longitudinal alignment with the T-shaped portion 276*b*, also for a reason to be discussed hereinafter. The lower ends of the depending outer leg portions 276*a* are each provided with a forwardly directed lug 280 (FIG. 10) which, when the saddle assembly 60 is assembled to the soleplate, skirt, and housing/handle assembly 42, 48, 54, are engageable beneath the rear edge of the bottom wall 216*a* of the front end portion 216 of the housing/handle 54 (FIGS. 1 and 4) and against the rear ends of raised abutments 282 provided on the top portion 48*a* of the skirt 48 (FIG. 11). In assembling the saddle assembly 60, the front end is tilted downwardly to first properly engage the lugs 280 as described, after which the rear end is forced downwardly. As may be seen in FIGS. 1, 4 and 9, the rear surface of the front end 216 and the forward surface of the rear end 218 of the housing/handle 54 are provided at the top and sides thereof with ledge formations 284*a* and 284*b*, respectively, (FIG. 9) for receiving the front and rear edges of the saddle assembly 60 whereby to provide a smooth fit of the saddle assembly 60 in the housing/handle 54. Depending from each of the outwardly inclined outer wall portions 268 at the rear of saddle assembly 60 and generally in transverse alignment with the rear inverted T-shaped formation 278 is a stabilizing rib 286, which ribs 286 engage against the top portion 48*a* of the skirt 48 and also against the rear ends of still another pair of raised abutments 288 provided on the top portion 48*a* of the skirt 48 (FIGS. 10 and 11). As noted, the ledge formations 284*a* and 284*b*, lugs 280, the inner side wall portions 270 and the rear stabilizing ribs 286 all cooperate to stabilize the saddle assembly 60 against forward and rearward and transverse movement relative to the skirt, housing/handle subassembly 48, 54. As an aid to the lugs 280 in preventing inadvertent and undesirable upward disassembly of the saddle assembly 60 from the housing/handle 54, the rear surface of the front end 216 of the housing/handle 54 is provided between the rail members 228 with a pair of laterally spaced apart, rearwardly projecting abutments 290 (FIGS. 10 and 14) and the forward surface of the rear end 218 of the housing/handle 54 is provided between the rail members 228 with a pair of laterally spaced apart, forwardly projecting abutments 292 (FIGS. 10 and 13). As the saddle assembly 60 is assembled to the housing/handle 54, the front inverted T-shaped portion 276*b* of the M-shaped front wall 276 is momentarily flexed rearwardly as a result of engagement of the crossbar thereof with the abutments 290 and the rear inverted T-shaped formation 278 is momentarily flexed forwardly as a result of engagement of the crossbar thereof with the abutments 292. As the saddle assembly 60 is seated in the housing/handle 54, the crossbar of the inverted T-shaped portion 276*b* and the crossbar of the inverted T-shaped formation 278 clear the abutments 290 and 292, respectively, whereupon the inverted T-shaped formation 276*b* unflexes forwardly into latching engagement with the undersides of the abutments 290 and the inverted T-shaped formation 278 unflexes rearwardly into latching engagement with the undersides of the abutments 292. As shown, the crossbars of the inverted T-shaped formations 276*b* and 278 and the abutments 290 and 292 may be provided with suitable inclined camming surfaces to facilitate the foregoing latching assembly. It is again noted that the saddle assembly 60 is easily and quickly assembled to the soleplate, skirt, housing/handle assembly 42, 48, 54, without the use of tools or mechanical fasteners.

Referring again to the steam control assembly 52, a transverse slot 294 is provided across the front end of the top wall 266 of the saddle assembly 60 with the front edge of the slot 294 being generally aligned vertically with the rear surface of the M-shaped front wall 276. The vertical leg portion of the inverted T-shaped portion 276*b* of the front wall 276 is provided with a bearing opening 296 (FIG. 14) for rotatably supporting one (front) pivot pin 298 of the rocker member 258, a second (rear) pivot pin 300 of the rocker member 258 is rotatably supported in a bearing formation 302 (FIG. 16) defined by a pair of arms 302*a* and 302*b* having facing concave surfaces which depend from the underside of the top wall 266 of the saddle member 60 and are formed integrally therewith in general alignment with the rear edge of the rocker member slot 294 and with the lower ends thereof being spaced apart sufficiently to define a narrowed detent, as at 302*c*, which both facilitates assembly of the pivot pin 300 into the bearing formation 302 and then serves to retain the pivot pin 300 in the bearing formation 302 during use of the iron 40, as illustrated in FIG. 16. To facilitate assembly of the front pivot pin 298 in the bearing opening 296, a vertical slot 304 (FIG. 14) is provided in the vertical leg portion of the inverted T-shaped portion 276*b*. below the bearing opening 296 but connected thereto by a narrow detent 304*a*, the width of the slot 304 being slightly greater than the diameter of the bearing opening 296. Also facilitating assembly of the front pivot pin 298 is a notch 296*a* (FIG. 14) provided in the inverted T-shaped portion 276*b* at the top of the bearing opening 296.

Depending from the underside of the saddle top wall 266 and integral therewith at opposite ends of the rocker member slot 294 are a pair of inwardly biased flexible detent members 306*a* and 306*b* (FIGS. 15, 16 and 17), each of which is characterized by an inwardly directed detent 306*c* and 306*d*, respectively.

The rocker member 258, as best illustrated in FIGS. 4, 9, and 15–17, which is characterized by a double-wall construction, is supported in the slot 294 midway between its opposite ends for rocking movement on and relatively to the saddle assembly 60 by the pivot pins 298 and 300 rotatably supported in the bearing opening 296 and the bearing formation 302, respectively. The mid-section of the rocker member 258 is characterized by depending, inverted triangular formations 308 (FIG. 16), each having a pair of downwardly directed cogs or gear teeth 310 disposed in driving engagement with the gear teeth 260 on the steam/dry valve member 244 whereby rocking movement of the rocker member 258 serves to rotate the valve member 244 between its open "steam" position and its closed "dry" position. Depending from opposite ends of the rocker member 258 are extensions 312 having detent-receiving depressions 312*a* and 312*b* formed in the outer surfaces thereof for engagement by the inwardly directed detents 306*c* and 306*d* on the spring detent members 306*a* and 306*b* (FIGS. 16 and 17). Cooperating with the detent arrangements 306*c*/312*a* and 306*d*/312*b*, are stop members 314*a* and 314*b* (FIGS. 9 and 16) which are formed integrally with and extend rearwardly from the rear wall of the double-wall construction of the rocker member 258 for engagement with the underside of the saddle top wall 266 adjacent the rear edge of the rocker slot 294 provided therein. As illustrated in FIG. 9, suitable indicia, such as "STEAM" and "DRY/FILL", may be provided on the top surface of the rocker member 258 at opposite ends thereof.

When the "DRY/FILL" side of the rocker member 258 is pressed downwardly, as shown in FIG. 16, rotating the rocker member 258 clockwise, as viewed from the rear, the inwardly directed detent 306*d* becomes engaged in the depression 312*b* and the stop member 314*a* is engaged against the underside of the saddle top wall 266 and the valve member 244 has been rotated counterclockwise into its closed position (see FIGS. 16 and 19) for "dry" ironing (or filling of the reservoir 58). Conversely, when the "steam" side of the rocker member 258 is pressed downwardly, rotating the rocker member 258 counterclockwise, the inwardly directed detent 306*c* becomes engaged in the depression 312*a* and the stop member 314*b* is engaged against the underside of the saddle top wall 266 and the valve member 244 is rotated clockwise into its open position for "steam" ironing.

With reference to the heat or temperature control assembly 50, a longitudinally extending depression 316 is provided in the top of the saddle top wall 266 along one side thereof (FIG. 9) and a longitudinally extending slot 318, which extends through the saddle top wall 266, is centered therein whereby to define a peripheral shelf 320 which extends around both sides and both ends of the slot 318. A diamond-shaped lever 322 has one end pivotally mounted on a stub shaft 324 which depends from the underside of the saddle top wall 266 (FIGS. 9 and 15), integral therewith, and positioned on the opposite side of the saddle top wall 266 from the slot 318, whereby the opposite end of the lever 322 is pivotable relative to the underside of the saddle top wall 266 and in an arc across the underside of the slot 318. The heat control button 62, as best illustrated in FIG. 15, has a finger-engageable portion 62*a* which is slidable in the depression 316 on the shelf 320, a depending narrowed guide portion 62*b* which is slidable in the slot 318, a cylindrical portion 62*c* which depends from the narrowed portion 62*b* and extends through an elongated open-ended slot 322*a* formed in the non-pivotably mounted end of the lever 322, and an enlarged head portion 62*d* which extends across the underside of the sides of the lever slot 322*a* to prevent inadvertent disconnection of the lever 322 from the heat control button 62. With the foregoing arrangement, forward linear movement of the heat control button 62 in the slot 318 causes clockwise pivoting movement (as viewed from the top) of the lever 322 and rearward linear movement of the heat control button 62 in the slot 318 causes counterclockwise pivoting movement (also as viewed from the top) of the lever 322. As is obvious, during the foregoing pivoting movements of the lever 322, the narrowed guide portion 62*b* of the heat control button 62, while being manually moved linearly in the slot 318, is also simultaneously moving linearly in and relative to the length of the lever slot 322*a*, which compound movement results in the pivoting movements of the lever 322.

Means are provided for utilizing the pivoting movement of the lever 322 for adjusting the heat or temperature setting of the thermostat 46. As best illustrated in FIGS. 4, 10 and 15, in the embodiment of the invention shown in the drawings, an arcuate wall 330 depends integrally from the underside of the lever 322 approximately midway between the slotted end and the pivotally mounted end of the,lever 322 and with the center of the arc of the arcuate wall 330 lying on the pivotal axis of the lever 322. The arcuate wall 330 has a series of gear teeth 332 formed on its inner surface for engagement with the teeth of the pinion gear 188 of the thermostat 46 whereby pivoting movement of th lever 322 as a result of linear movement of the heat control button 62 varies the temperature setting of the thermostat 46. Obviously, other drive mechanisms could be provided between the lever 322 and the thermostat 46. For instance, to minimize any binding between the parts, a universal-type coupling could be utilized. Another possible arrangement to minimize frictional binding would be the provision of a depending guide rib 334 (FIGS. 4 and 15) on the underside of the saddle top wall 266 inwardly of the slot 318 against which the lever 322 may slide. Suitable indicia markings (not shown) may be provided alongside the depression 316 and the path of the heat control button 62 which correspond to suitable temperature settings of the thermostat 46 for dry and steam ironing a variety of different fabrics.

Figures 23, 24, 25, 26, 27:
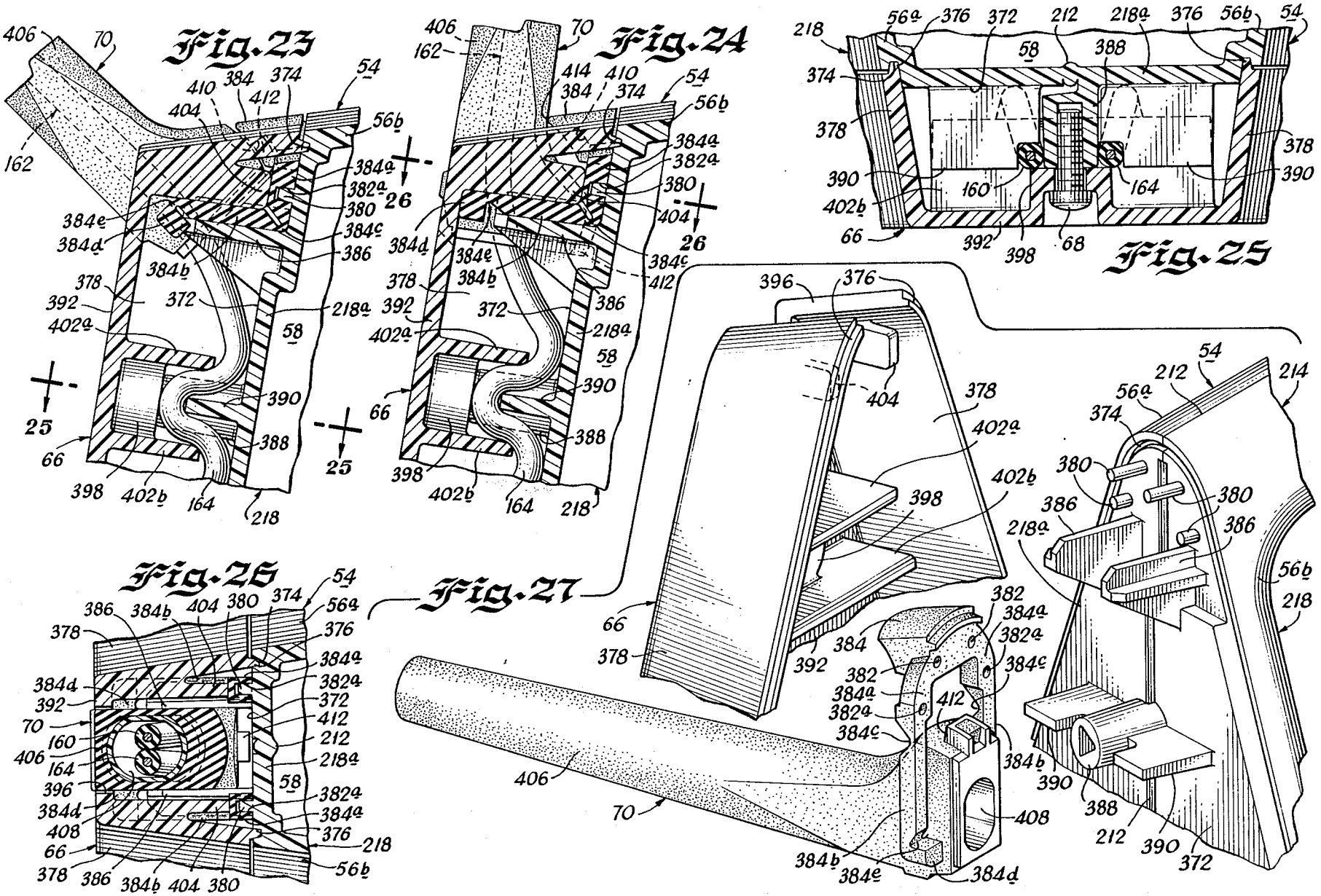
FIG. 23 is an enlarged partial vertical sectional detail view taken generally on line 23—23 of FIG. 3 showing the cord boot in its out-of-the-way use position.
FIG. 24 is an enlarged partial vertical sectional detail view similar to FIG. 23 with the cord boot in its other position as shown in broken line in FIG. 1.
FIG. 25 is a sectional detail view taken generally on line 25—25 of FIG. 23.
FIG. 26 is a sectional detail view taken generally on line 26—26 of FIG. 24.
FIG. 27 is an enlarged exploded perspective view of the parts forming the pivotal cord boot.
Figure 29:
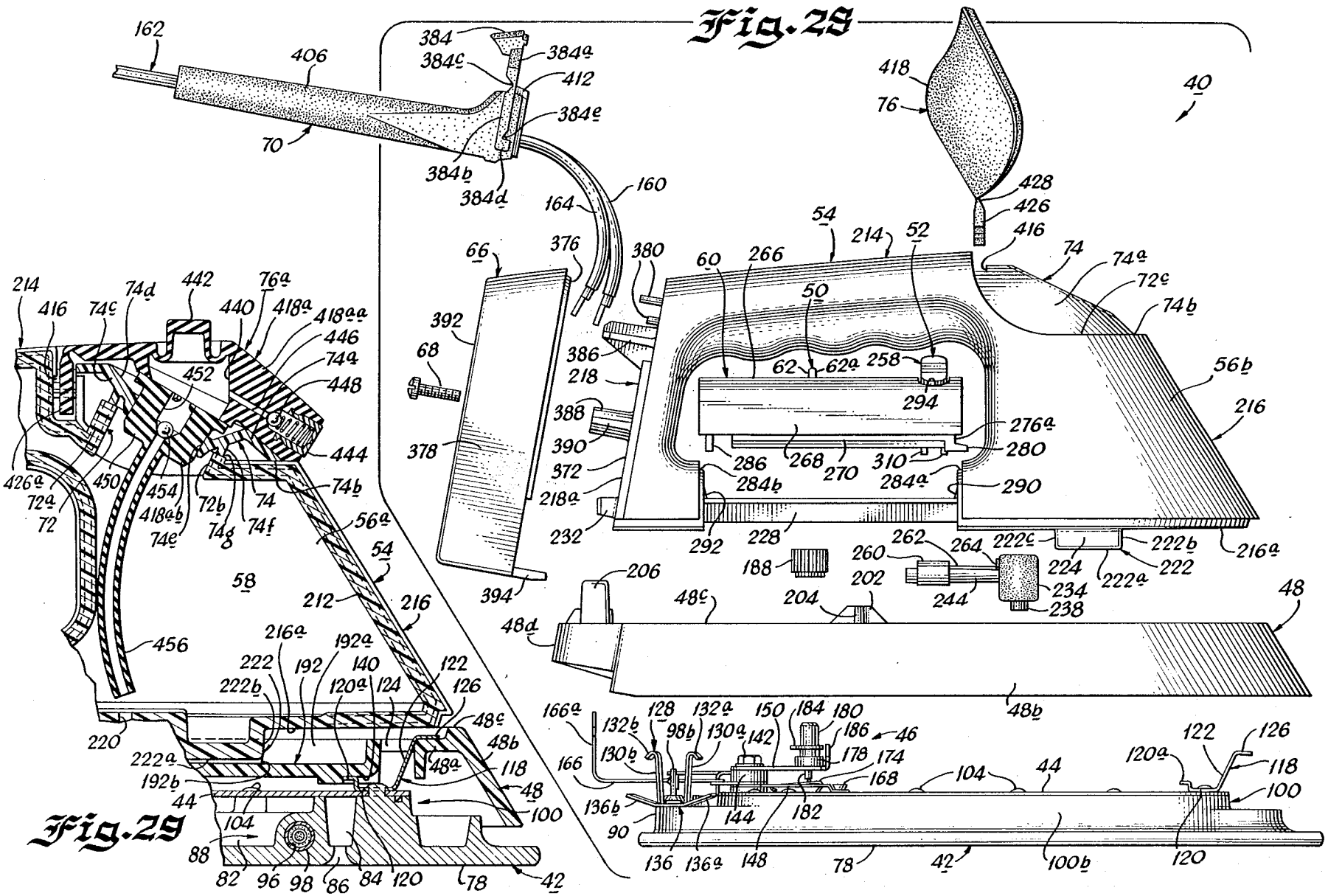
FIG. 29 is a partial vertical sectional view of the forward end of the iron as shown in FIG. 4 but showing a spray nozzle vent cap substituted for the non-spray vent cap shown in FIG. 4.

To accommodate the end cap 66 and the cord boot 70, a rear face 372 of the rear wall 218*a* of the rear end 218 of the housing/handle 54, as best illustrated in FIG. 27, is provided along the sides of its generally triangular periphery with a groove 374 adapted to receive forwardly projecting ribs 376 provided on side walls 378 of the end cap 66. The rear face 372 is further provided with a series of four rearwardly extending integral mounting pins 380 adapted to be received in a pair of bores 382 provided in a mounting or anchor-bridge member 384 of the cord boot 70 and in a pair of lower bores 382*a* provided in laterally spaced apart first side arm portions or hinge-anchors 384*a* of the mounting member 384; with a pair of integral rearwardly projecting, laterally spaced apart L-shaped shelf formations 386 for supporting laterally spaced apart second side arm portions or hinge-anchors 384*b* of the mounting member 384 which are connected to the lower ends of the first side arm portions 384*a* by living hinges, as at 384*c*; with an integral rearwardly projecting fastener socket formation 388 which is disposed in a vertical plane through the longitudinal axis of the iron 40; and with a pair of integral rearwardly projecting generally horizontally aligned guide formations 390 disposed on either side of the socket formation 388.

As best shown in FIGS. 1, 3, 4, 27 and 28, the end cap 66 is generally triangular in configuration and characterized by a rear wall 392, a bottom wall 394, and the upwardly converging side walls 378. A notch 396 is provided in the top of the end cap 66 to accommodate the earlier mentioned movement of the cord boot 70. The bottom wall 394 of the end cap 66 extends forwardly beyond the forward edges of the side walls 378 whereby, as can best be seen in FIGS. 1, 3, 4, and 29, the forward extension thereof serves to close off the underside of a rear portion 48*d* of the skirt 48 not closed off by the soleplate 42. A bored abutment 398 extends forwardly from and integral with the rear wall 392 of the end cap 66 and is positioned for coaxial alignment with the fastener socket formation 388 provided on the rear face 372 of the rear end 218 of the housing/handle 54 when the end cap 66 is assembled on the sole plate, skirt, housing/handle subassembly 42, 48, 54. It is noted that the cord boot 70, which will be described in greater detail hereinafter, must be mounted on the rear face 372 of the rear end 218 of the housing/handle 54 prior to the aforesaid assembly of the end cap 66. The threaded fastener 68 (FIG. 25), the only one used in the assembly of the iron 40, may then be used to fixedly attach the end cap 66 to the housing/handle 54.

Projecting forwardly and integrally with the rear wall 392 of the end cap 66 immediately above and below the bored abutment 398 are a pair of flat, generally horizontal guide formations 402*a* and 402*b*. The guide formations 402*a* and 402*b*, which terminate rearwardly of the forward edges of the side walls 378, cooperate with the rearwardly projecting guide formations 390 in a manner to be described hereinafter to serve as a power cord retainer. It is noted, however, that when the end cap 66 is mounted on the housing/handle 54, the guide formations 390 are disposed, in a generally vertical direction, approximately midway between the guide formations 402*a* and 402*b* on the end cap 66 and that the rear edges of the guide formations 390 are disposed rearwardly of the forward edges of the guide formations 402*a* and 402*b*, but forwardly of the rear wall 392 of the end cap 66.

Also projecting forwardly from and integral with the rear wall 392 of the end cap 66 adjacent the upper end thereof are a pair of retaining members 404, one each being disposed on opposite sides of the notch 396 (FIG. 27). When the cord boot 70 and the end cap 66 are assembled on the housing/handle 54, the forward ends of the retaining members 404 abut against the rearwardly facing surfaces of the first side arms 384*a* of the cord boot 70 to retain the first side arms 384*a* against the rear face 372 of the rear end 218 of the housing/handle 54 and the undersides of the retaining members 404 abut against the upper surfaces of the second side arm portions 384*b* to retain the second side arm portions 384*b* on the L-shaped shelves 386, as best illustrated in FIGS. 23, 24 and 26.

The cord boot 70 which is preferably formed of a flexible rubber-like material is characterized, in addition to the mounting or anchor-bridge member 384, by an elongated main body portion 406 having a bore 408 provided therein through which passes the power cord 162 (FIGS. 4, 23, 26 and 28). The lower end of the main body portion 406 is integrally connected to the mounting or anchor-bridge member 384 by a pair of hinge arms 384*d* which project integrally from the opposite sides of the lower end of the main body portion 406 and are connected to the rear or lower ends of the shelf-supported second side arms 384*b* by living hinges, as at 384*e* in FIGS. 27 and 28. A notch 410 (FIGS. 4 and 24) is centrally located in the lower rear edge of the mounting or anchor-bridge member 384 of the cord boot 70 and an integral stop member 412 (FIGS. 4, 26 and 27) extends generally forwardly from the lower end of the main body portion 406 in alignment with the notch 410, the stop member 412 being receivable in the notch 410 (FIG. 4) in the rearmost out-of-the-way ironing position of the cord boot 70 as shown in full line in FIG. 1 and in FIGS. 4 and 24. The cord boot 70 is pivotal forwardly through approximately 60° about the living hinges 384*e* (FIGS. 23 and 24) into its second upright position shown in broken line in FIG. 1 and in FIG. 24, in which position it serves as an aid in supporting the iron 40 in an upright position on its heel rest or rear end. In this position, the main body portion 406 of the cord boot 70 engages, as a stop, the upper rear edge of the mounting or anchor-bridge member 384 of the cord boot 70, as best shown at 414 in FIG. 24.

Figure 3:
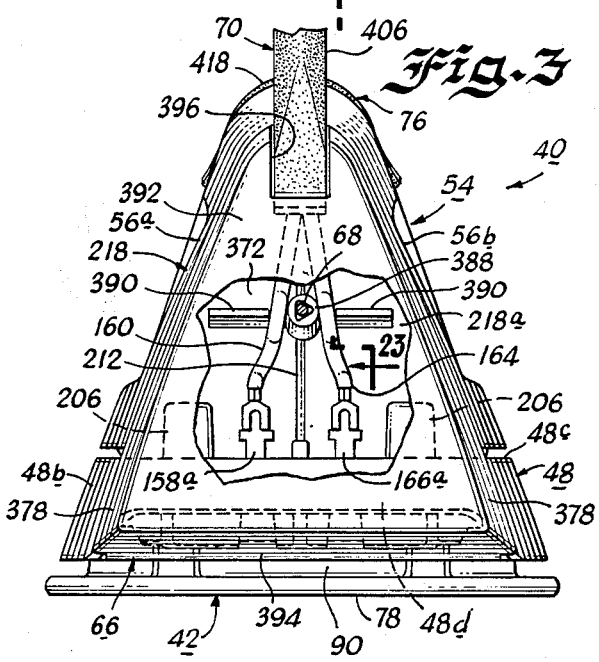
FIG. 3 is a rear end elevational view of the iron as shown in FIG. 1, partially broken away to show the electrical connections to the heating element.

The power cord 162, as best illustrated in FIGS. 3, 4, 23 and 24, passes through the main body portion 406 of the cord boot 70, with the two leads 160 and 164 thereof then being laterally spread apart whereby they pass on opposite sides of the fastener socket 388 and over the forward edge of guide formation 402*a*, then rearwardly, downwardly and forwardly around the rear edges of the guide formations 390, and then downwardly past the forward edge of guide formation 402*b* with the lead 160 being connected by a suitable connector to the upward end 158*a* of the angular connector 158 and with the lead 164 being connected by a suitable connector to the upward end 166*a* of the angular connector 166, as best shown in FIG. 3. The foregoing arrangement of guide formations 390, 402*a* and 402*b* serve as a very effective cord retainer/strain relief for the power cord 162 and its leads 160 and 164.

As best illustrated in FIGS. 23 and 24, the location of the living hinges 384*e* is such that the bending of the power cord 162 during pivotal movement of the cord boot 70 is through a relatively large radius whereby to minimize bending stress thereon as a result of backward and forward pivotal movement of the cord boot 70 and thus maximize the life of the power cord 162. The lower end of the main body portion 406 and the mounting or anchor-bridge member 384 of the cord boot 70 are designed such that they cooperatively completely fill the notch 396 at the top of the end cap 66 in all pivotal positions of the cord boot 70 with the appropriate surfaces of the cord boot 70 blending into the adjacent surfaces of the end cap 66 and the housing/handle 54 in a smooth manner, as best illustrated in FIGS. 1, 4, 23 and 24.

As mentioned earlier herein, the fill-funnel formation 74 heat sealed in the fill opening 72 is provided with a vent cap 56 (FIGS. 1, 2, 4, 5, 6 and 28) which is formed of a rubber-filled polypropelene, such as Monsanto's Santoprene. The fill opening 72 defined by the heat sealed clam-shell portions 56*a* and 56*b* of the housing/-handle 54 is characterized by an upwardly and forwardly inclined sleeve portion 72*a* defining an opening 72*b* and by a peripheral shelf 72*c* which curves upwardly on both sides in a rearward direction. The fill-funnel formation 74 disposed in the fill opening 72 has a first generally conical outer body portion 74*a* which is heat sealed at its outer edge to the shelf 72*c* inwardly of the outer edge thereof, as at 74*b*, an integral inverted conical portion 74*c* defining a funnel configuration 74*d* extending into the opening 72*b* and having an opening or bore 74*e* provided at the bottom thereof, and a wall section 74*f* depending from the conical portion 74*c* and heat-sealed at its bottom edge to the upper edge of the sleeve portion 72*a*, as at 74*g*. A vertical slot 416 (FIGS. 1 and 4) is provided in the conical portion 74*c* in the upper rear surface thereof adjacent a vertical portion of shelf 72*c* for a purpose to be described hereinafter.

The vent cap 76 is characterized by a hood portion 418 adapted to be fitted over the conical portion 74*c* of the fill-funnel formation 74 with its outer edges disposed against the outer portion of the shelf 72*c* and by an integral, centrally located, depending sleeve portion 420 having a bore 422 defined therein. A vent passage 424 extends from the bore 422 through the hood portion 418. An integral mounting member or anchor 426, which is connected to the hood portion 418 by a living hinge 428 (FIGS. 4 and 28), is insertable into the slot 416 where it is anchored by any suitable known type detent means, as in FIG. 6, whereby to connect the vent cap 76 to the iron 40 and permit pivoting movement thereof between its open "fill" position shown in broken line in FIG. 1 and its closed "operating" position shown in full line in FIGS. 1, 2, 4 and 5, in which latter position the sleeve portion 420 is sealingly received in the funnel bore 74*e*. A check valve assembly 430 is provided in the bore 422 to permit the release of pressure to atmosphere while preventing any leakage of water from the reservoir 58 through the vent passage 424 should the iron 40 be positioned nose-up. The check valve assembly 430 includes a body portion 432 having suitable passages and an orifice 434 provided therein and a ball valve 436, as best shown in FIGS. 4 and 5. The check valve assembly 430 is retained in the bore 422 by flexible inwardly turned detent shoulders 438 provided at the open end of the bore 422.

If the iron 40 is to be of the type having a forward spray feature, a different form of vent cap 76*a* (FIG. 29) may be substituted for the vent cap 76. The two-part hood 418*a* has a similar mounting member or anchor 426*a* anchored in the slot 416 but is otherwise somewhat different in design. The upper portion 418*aa* of the hood portion 418*a* is characterized by a pump chamber 440, by an accordian-type manually-operable pump button 442 in the upper portion of the pump chamber 440, and by a downwardly and forwardly directed spray nozzle 444 provided in the front of the upper portion 418*aa* of the hood portion 418*a* with an inlet passage 446 extending between the pump chamber 440 and the spray nozzle 444, the spray nozzle 444 having a check valve 448 incorporated therein.

The lower portion 418*ab* of the hood portion 418*a* is characterized by a plug member 450 which is secured by suitable adhesive means to the underside of the upper portion 418*aa* and across the open lower end of the pump chamber 440. The plug member 450 which is sealingly receivable in the bore 422, as is the sleeve portion 420 of the non-spray vent cap 76 in the bore 74*e*, is provided with a central bore 452 which is open to the pump chamber 440 at its upper end and which has a valve seat at its lower end for a ball check valve 454 and a tubular inlet conduit 456 which depends from the valve seat toward the bottom of the reservoir 58. Reciprocation of the pump button 442 pumps water from the reservoir 58 upwardly through the inlet tube 456 into the pump chamber 440 and then out through the spray nozzle 444 in a known manner.

Interchangeable use of the vent caps 76 and 76*a* permits simple assembly of either non-spray or spray steam/dry irons, either utilizing the extremely simple, quick and novel assembly operation disclosed herein which requires no tools and only a single threaded fastener.

While there has been shown and described a preferred embodiment of the invention, it will be obvious to those skilled in the art that changes and modifications may be made without departing from the invention, and it is intended by the appended claims to cover all such changes and modifications as fall within the true spirit and scope of the invention.

What we claim as new and desire to secure by Letters Patent of the United States is:

1. A pressing iron comprising an aluminum soleplate having a tapered front end and a flat rear end, a plastic skirt mounted on and being coextensive with said soleplate, a plastic housing/handle mounted on said plastic skirt and having a saddle portion, a heat control mounted on said soleplate, and a linearly movable slide control on said saddle portion for controlling adjustment of said heat control, a rear cap secured to said housing/handle at the rear end of said soleplate, and a cord boot having a first portion which is clamped in assembled relation to said iron between said cap and said housing/handle, said cord boot having a second portion which is pivotal with respect to said iron and said first portion.

2. A pressing iron as defined in claim 1 wherein said cord boot comprises a one-piece plastic member having living hinge means between said first and second portions and which facilitates pivoting movement of said second portion thereof between an upper position wherein the boot aids in stabilizing the iron when the iron is in its upright rest position and a lower out-of-the way position during use of the iron.

3. A pressing iron as defined in claim 2 where in said second portion of said cord boot is pivotal through approximately 60 degrees between its two positions.

4. A pressing iron as defined in claim 1 wherein said linearly movable slide control is adapted to pivot a lever arm having a toothed formation provided thereon for driving engagement with said heat control.

5. A pressing iron comprising an aluminum soleplate having steam ports, a plastic skirt mounted on said soleplate, a plastic clam-shell housing/handle defining a water reservoir therein mounted on said plastic skirt, a fill-funnel formation provided in said housing/handle to provide access to fill said reservoir, and a vented closure cap for said fill-funnel, said cap including a check valve which is normally open to vent air into said reservoir when said soleplate is in a horizontal position and is displaced to a closed position to prevent water from passing outwardly through said valve upon movement of said soleplate away from said horizontal position said cap being pivotally connected to said housing handle and movable between a closed position sealing said fill-funnel and an open position permitting access to said fill-funnel for filling said reservoir.

6. A pressing iron as defined in claim 5 wherein said cap is formed of rubber-like material with one portion anchored in a slot provided in said housing/handle adjacent said fill-funnel formation.

7. A pressing iron comprising an aluminum soleplate having steam ports, a plastic skirt mounted on said soleplate, a plastic clam-shell housing/handle defining a water reservoir therein mounted on said plastic skirt, a fill-funnel formation provided in said housing/handle to provide access to fill said reservoir, and a vented closure cap for said fill-funnel, said cap being pivotally connected to said housing/handle and movable between a closed position sealing said fill-funnel for an open position permitting access to said fill-funnel for filling said reservoir, said cap having associated therewith a spray nozzle, a pump, and an inlet tube which extends into said reservoir.

8. A pressing iron comprising an aluminum soleplate having steam ports, a plastic skirt mounted on said soleplate, a plastic housing/handle defining a water reservoir therein mounted on said plastic skirt and having a saddle portion, said housing/handle having an elongated hand grip portion with front and rear ends, said housing/handle having a front end portion and a rear end portion extending downwardly from said front and rear ends of said hand grip portion, said end portions being supported at their lower ends by said skirt, said saddle portion being spaced below said hand grip portion and extending between said front end portion and said rear end portion, a steam control mounted on said saddle portion for controlling an orifice between said reservoir and said ported soleplate.

9. A pressing iron comprising an aluminum soleplate having steam ports, a plastic skirt mounted on said soleplate, a plastic housing/handle defining a water reservoir therein mounted on said plastic skirt and having a saddle portion, a steam control mounted on said saddle portion for controlling an orifice between said reservoir and said ported soleplate, said steam control being characterized by a horizontally disposed cylindrical portion having a first series of teeth formed thereon and projecting generally upwardly, and wherein a rocker arm is pivotally mounted on said saddle portion and has depending formation means provided with a second series of teeth adapted to intermesh with said first series of teeth on said steam control whereby manual operation of said rocker arm either opens or closes said orifice between said reservoir and said ported soleplate, said rocket arm having a "steam" position in which said orifice is open and an "dry" position in which said orifice is closed.

10. A pressing iron as defined in claim 9 wherein integral flexible detent members are provided on said saddle portion for engagement with opposite ends of said rocker arm in both "steam" and "dry" positions thereof.

11. A pressing iron comprising an aluminum soleplate having steam ports, a plastic skirt mounted on said soleplate, a plastic housing/handle having a water reservoir defined therein mounted on said plastic skirt and having a saddle portion, a heat control mounted on said soleplate for rotation about a vertical axis, and a linearly movable slide control on said saddle portion for controlling adjustment of said heat control, and a lever arm mounted on said skirt to convert linear movement of said slide control into rotation of said heat control.

12. A pressing iron as defined in claim 11 wherein said lever arm includes a toothed formation provided thereon and for rotational driving engagement with corresponding formations on said heat control, a slot connected between said slide control and said lever whereby movement of said slide rotates said lever and said heat control.

13. A steam pressing iron comprising an aluminum soleplate having a steam chamber and steam ports for discharging steam through the soleplate, a plastic skirt having means engageable with means on said soleplate for releasably snapping said skirt into assembled engagement with said soleplate, a unitary plastic handle defining a water reservoir therein and having portions which interengage with said plastic skirt to lock said handle and skirt in assembled relation without any independent fastening means, conduit means extending between said reservoir and said soleplate to conduct water to said steam chamber, a heat control mounted on said soleplate, a steam control for controlling water flow through said conduit, a plastic saddle mounted on said handle, said handle having an elongated hand grip portion having a front end and a rear end, said handle having a front end portion and a rear end portion extending downwardly from said front end and said rear end of said hand grip portion, said saddle being spaced below said grip portion and coextensive therewith extending between said front end portion and said rear end portion, a control on said saddle for controlling adjustment of said heat control, and means mounted on said saddle for controlling said steam control.

14. The steam pressing iron of claim 13 wherein said skirt is formed of a high temperature phenolic plastic which functions as a temperature shield between said handle and said soleplate, said skirt having a generally flat planar portion which is parallel to and coextensive with said soleplate and a skirt portion which extends from the periphery of said planar portion into closely spaced relationship with the periphery of said soleplate.

15. A steam pressing iron comprising an aluminum soleplate having a steam chamber and steam ports for discharging steam through the soleplate, a plastic skirt releasably snapped into engagement with said soleplate, a unitary plastic handle defining a water reservoir therein and having portions which interengage with said plastic skirt to lock said handle and skirt in assembled relation without any independent fastening means, conduit means extending between said reservoir and said soleplate to conduct water to said steam chamber, a heat control mounted on said soleplate, a steam control for controlling water flow through said conduit, a plastic saddle mounted on said handle, a control on said saddle for controlling adjustment of said heat control, and means mounted on said saddle for controlling said steam control, said skirt being formed of a high temperature phenolic plastic which functions as a temperature shield between said handle and said soleplate, said skirt having a generally flat planer portion which is parallel to and coextensive with said soleplate and a skirt portion which extends from the periphery of said planer portion into closely spaced relationship with the periphery of said soleplate, said handle and said skirt being formed with longitudinally extending projections and recesses forming a dovetail connection to retain said handle with respect to said skirt.

16. The steam pressing iron of claim 15 wherein said handle and said skirt have integrally molded projections which interengage to lock said dovetail connection against relative movement of said handle and said skirt longitudinally of said soleplate.

17. A steam pressing iron comprising an aluminum soleplate having a steam chamber and steam ports for discharging steam through the soleplate, a plastic skirt releasably snapped into engagement with said soleplate, a unitary plastic handle defining a water reservoir therein and having portions which interengage with said plastic skirt to lock said handle and skirt in assembled relation without any independent fastening means, conduit means extending between said reservoir and said soleplate to conduct water to said steam chamber, a heat control mounted on said soleplate, a steam control for controlling water flow through said conduit, a plastic saddle mounted on said handle, a control on said saddle for controlling adjustment of said heat control, and means mounted on said saddle for controlling said steam control, said soleplate having a pointned front end and a flat rear end, said handle being formed with a front support post adjacent said soleplate front end and a rear support post adjacent said soleplate rear end, a hand grip portion extending across the top of said support posts and a connecting rail extending between the bottom ends of said support posts, at least one projection and a cooperating recess in said skirt and said handle forming a dovetail connection to retain said skirt to said handle.

18. The steam pressing iron of claim 17 wherein said dovetail connection is disengageable by rectilinear movement of said handle relative to said skirt in a disengaging direction, said connecting rail and said skirt having additional projections which lock said handle and skirt against movement in said disengaging direction.

19. The steam pressing iron of claim 13 wherein interengageable means are provided on said handle and said saddle to lock said saddle against upward movement relative to said handle.

20. A steam pressing iron comprising an aluminum soleplate having a steam chamber and steam ports for discharging steam through the soleplate, a plastic skirt releasably snapped into engagement with said soleplate, a unitary plastic handle defining a water reservoir therein and having portions which interengage with said plastic skirt to lock said handle and skirt in assembled relations without any independent fastening means, conduit means extending between said reservoir and said soleplate to conduct water to said steam chamber, a heat control mounted to said soleplate, a steam control for controlling water flow through said conduit, a plastic saddle mounted on said handle, a control on said saddle for controlling adjustment of said heat control, and means mounted on said saddle for controlling said steam control, interengageable means being provided on said handle and said saddle to lock said saddle against upward movement relative to said handle, said interengageable means comprising front and rear flexible members on said saddle which are engageable over rearwardly and forwardly projecting members formed respectively on front and rear positions of said handle.

21. The steam pressing iron of claim 13 wherein said saddle has side wall configurations providing ventilation between said skirt and said saddle.

22. A steam pressing iron comprising an aluminum soleplate having a steam chamber and steam ports for discharging steam through the soleplate, a plastic skirt releasably snapped into engagement with said soleplate, a unitary plastic handle defining a water reservoir therein and having portions which interengage with said plastic skirt to lock said handle and skirt in assembled relation without any independent fastening means, conduit means extending between said reservoir and said soleplate to conduct water to said steam chamber, a heat control mounted on said soleplate, a steam control for controlling water flow through said conduit, a plastic saddle mounted on said handle, a control on said saddle for controlling adjustment of said heat control, and means mounted on said saddle for controlling said steam control, said saddle having side wall configurations providing ventilation between said skirt and said saddle, said side wall configuration being characterized by a double-wall construction.

23. The steam pressing iron of claim 13 wherein said skirt, said handle and said saddle have interengaging means locking said saddle against sidewise and forward and rearward movement relative to said handle.

24. A pressing iron comprising an aluminum soleplate having steam ports, a plastic skirt releasably snapped into engagement with said soleplate, a plastic clam-shell housing/handle defining a water reservoir therein and having a dovetail configuration interconnecting said housing/handle to said plastic skirt, a heat control mounted on said soleplate for rotation about a vertical axis, a steam control mounted on said skirt and rotatable about a horizontal axis for controlling an orifice between said reservoir and said soleplate, a plastic saddle snapped into position in said housing/handle, a linearly movable slide control on said saddle for controlling adjustment of said heat control, a rocker arm pivotally mounted on said saddle for controlling said steam control, said rocker arm being movable between a "steam" position in which water may flow through said orifice from said reservoir to said soleplate and a "dry" position in which flow of water from said reservoir to said soleplate is obstructed, a rear cap secured to said housing/handle, a cord boot mounted on said rear cap for movement between two positions, and a vent-cap provided for a fill-funnel formation provided in said housing/handle.

25. A pressing iron as defined in claim 24 wherein said rotatable steam control is characterized by a cylindrical portion having a first series of teeth formed thereon and projecting generally upwardly, and wherein said pivotally mounted rocker arm has depending formation means provided with a second series of teeth adapted to intermesh with said first series of teeth on said steam control whereby manual operation of said rocker arm either opens or closes said orifice between said reservoir and said ported soleplate.

26. A pressing iron as defined in claim 24 wherein integral flexible detent members are provided on said saddle portion for engagement with opposite ends of said rocker arm in both said "steam" and "dry" positions thereof.

27. A pressing iron as defined in claim 24 wherein a pair of spring clamps are secured to the rear of said soleplate for clamping engagement with slots in the rear portion of said skirt.

28. A pressing iron as defined in claim 27 wherein said pair of spring clamps are also provided with out-rigger leaf spring stabilizing means for said skirt.

29. A pressing iron as defined in claim 24 wherein the lower rear portion of said housing/handle is provided with a pair of rearwardly extending projections which are received in recessed abutments upstanding from the rear of said skirt when said housing/handle is assembled to said skirt.

30. A pressing iron as defined in claim 24 wherein said housing/handle is characterized by an upper handle portion, by a front end portion depending from the front end thereof, by a rear end portion depending from the rear end thereof, and by a pair of spaced parallel rail portions extending between the lower portions of said front and rear end portions, the inner facing surfaces of said rail portions being provided with aligned inwardly and forwardly inclined projections releasably engageable behind spaced upstanding projections on said skirt when said housing/handle is assembled on said skirt, said rail portions being momentarily flexed outwardly by the engagement of said inclined projections on said rail portions with said upstanding skirt projections during assembly of said housing/handle to said skirt until said inclined projections clear said skirt projections.

* * * * *